US011035560B1

(12) United States Patent
Lu et al.

(10) Patent No.: US 11,035,560 B1
(45) Date of Patent: Jun. 15, 2021

(54) OPTICAL COMMUNICATION LAMP DEVICE

(71) Applicant: Xiamen PVTECH Co., Ltd., Fujian (CN)

(72) Inventors: Fuxing Lu, Fujian (CN); Rongtu Liu, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 16/853,778

(22) Filed: Apr. 21, 2020

(30) Foreign Application Priority Data

Jan. 21, 2020 (CN) ..... 202010071285.3

(51) Int. Cl.

| | |
|---|---|
| ***F21V 23/00*** | (2015.01) |
| ***F21V 29/507*** | (2015.01) |
| ***F21S 9/02*** | (2006.01) |
| *F21Y 103/10* | (2016.01) |
| *F21Y 115/10* | (2016.01) |
| *H05B 45/30* | (2020.01) |
| *H05B 47/19* | (2020.01) |
| *H05B 45/10* | (2020.01) |

(52) U.S. Cl.
CPC ..... *F21V 23/009* (2013.01); *F21S 9/022* (2013.01); *F21V 29/507* (2015.01); *F21Y 2103/10* (2016.08); *F21Y 2115/10* (2016.08); *H05B 45/10* (2020.01); *H05B 45/30* (2020.01); *H05B 47/19* (2020.01)

(58) Field of Classification Search
CPC .... F21V 23/003; F21V 23/009; F21V 29/507; F21V 19/0035; F21V 23/00; F21S 9/022; F21Y 2103/10; F21Y 2115/10; H05B 45/30; H05B 47/10; H05B 47/105
See application file for complete search history.

(56) References Cited

U.S. PATENT DOCUMENTS

| | | | | |
|---|---|---|---|---|
| 9,568,412 | B2 * | 2/2017 | Kajiyama | G01N 17/043 |
| 10,455,661 | B2 * | 10/2019 | Harada | H05B 45/20 |
| 2008/0273331 | A1 * | 11/2008 | Moss | F21V 17/168 362/294 |
| 2012/0013238 | A1 * | 1/2012 | Jonsson | F21K 9/23 313/110 |
| 2013/0049598 | A1 * | 2/2013 | Nagashima | F21K 9/278 315/113 |

* cited by examiner

*Primary Examiner* — Thai Pham
(74) *Attorney, Agent, or Firm* — Winston Hsu

(57) ABSTRACT

An optical communication lamp device is provided and the lamp device includes an emitting-end driving controller, a power unit, and a light emitting element. The light emitting element is electrically connected to the emitting-end driving controller and the power unit. The emitting-end driving controller receives an electrical signal to control the light emitting element.

8 Claims, 3 Drawing Sheets

OPTICAL COMMUNICATION LAMP DEVICE

BACKGROUND OF THE INVENTION

1. Field of the Invention

The present invention relates to a lamp device, in particular to an optical communication lamp device.

2. Description of the Prior Art

Emergency lights are lamp devices for emergency illuminations. The emergency lights are installed inside buildings, factories, or transportations. When there is an emergency, the emergency light can provide illumination.

The existing lamp tube, lamp devices, or lamp devices adopt wires for electrical connection in their design stages, production and assembly stages, and ex-factory stages. Though the electrical connection by wires is reliable, at least five disadvantages still exist.

The first disadvantage is that, the unstable cost of the devices due to extension or shortening of the wire when the lengths of the lamp tube, the lamp device, or the emergency light change. The second disadvantage is that, during the assembly, the wire may be damaged due to improper protection, thereby resulting short circuit. The third disadvantage is that, the application of the wire may lead the assembly efficiency decreasing. The fourth disadvantage is that, during the transportation or the installation, the wires are swayed to produce noises, thereby decreasing the applicability of the device. The fifth disadvantage is that, the device cannot provide an electrical isolation function. Regarding the fifth issue, at a place where electrical isolation is required, when the distance between two isolated systems is longer, the two systems cannot be wired connected. An alternative approach for achieving the electrical connection between two electrical-isolated systems is the application of optical couplers. However, the optical couplers are small components. As a result, when the distance between the two isolated systems is much longer, wires are still required for the electrical connection between the two isolated systems, thereby reducing the production efficiency.

Therefore, how to design an optical communication lamp device which facilitate the increasing of production efficiency, the increasing of product applicability, the reduction of noises, the implementation of no-wire electrical connection, and the reduction of floating costs, is an issue to be considered.

SUMMARY OF THE INVENTION

Accordingly, an optical communication lamp device is to be provided for introducing advantages of production efficiency increase, product applicability increase, noise reduction, no-wire electrical connection, and floating cost reduction.

In view of these, an optical communication lamp device is provided. The optical communication lamp device comprises an emitter-end driving controller, a power unit, and a light emitting element. The light emitting element is electrically connected to the emitting-end controller and the power unit. The emitting-end driving controller receives an electrical signal to control the light emitting element.

In some embodiments, the lamp device further comprises an emitting-end emitter and a receiving-end power circuit receiver. The emitting-end emitter is electrically connected to the emitting-end driving controller. The receiving-end power circuit receiver is electrically connected to the light emitting element. The emitting-end emitter converts the electrical signal into an optical signal radiated outwardly to a space where the lamp device is located. The receiving-end power circuit receiver receives the optical signal.

In some embodiments, the lamp device further comprises a receiving-end driving power circuit. The receiving-end driving power circuit is electrically connected to the receiving-end power circuit receiver and the light emitting element. The receiving-end power circuit converts the optical signal into a second electrical signal. A decoder of the receiving-end driving power circuit decodes the second electrical signal to be a decoded signal, and the decoder outputs the decoded signal to execute a corresponding function.

In some embodiments, the lamp device further comprises a lamp tube heat-dissipation member and a lampshade. The lamp tube heat-dissipation member has an assembly surface. The receiving-end driving power circuit, the receiving-end power circuit receiver, the emitting-end emitter, the power unit, and the emitting-end driving controller are disposed on the assembly surface. The lampshade covers the assembly surface, so that the receiving-end driving power circuit, the receiving-end power circuit receiver, the emitting-end emitter, the power unit, and the emitting-end driving controller are between the lampshade and the lamp tube heat-dissipation member. The light emitting member is disposed between the lampshade and the lamp tube heat-dissipation member.

In some embodiments, the lamp device further comprises at least one lamp socket. The lamp socket is disposed on one end of an assembly of the lampshade and the lamp tube heat-dissipation member. The lamp socket has a copper pin electrically connected to the light emitting element.

In some embodiments, the lamp device further comprises two lamp sockets. The two lamp sockets are respectively disposed on two ends of an assembly of the lampshade and the lamp tube heat-dissipation member.

In some embodiments, the lamp device further comprises a test switch and a test indicating light. The test switch and the test indicating light are disposed on one end of the lampshade and electrically connected to the light emitting element.

In one embodiment, the power unit is a battery or a chargeable battery. The emitting-end emitter is an optical emitting member. The receiving-end power circuit receiver is an optical receiving member.

In one embodiment, the light emitting element is a plate member having a plurality of light emitting diodes.

It is worthy to mention that, according to one or some embodiments, the electrical signal (with high and low level) is transmitted to the emitting-end emitter, and then is converted by the emitting-end emitter to be an optical signal with a specific wavelength, and the optical signal is radiated to the space where the lamp device is located. Next, the receiving-end power circuit receiver receives the signal from the emitting-end emitter and converts the optical signal into a second electrical signal (a duty ratio signal with a specific frequency). Then the second electrical signal is amplified to allow the receiving-end driving power circuit to perform the high and low level signal control.

The two electrical-isolated systems within the lamp tube and the enclosed lamp device are capable of performing communication through the optical emitting and receiving components. According to one or more embodiments of the present invention, issues of the electromagnetic waves produced by the control of the wired-connected components can be reduced. Compared with radiofrequency communication, optical communication does not generate additional radio frequency electromagnetic wave problems. According to one or some embodiments of the present invention, the production efficiency can be improved and the cost problem caused by using the wire can be reduced.

These and other objectives of the present invention will no doubt become obvious to those of ordinary skill in the art after reading the following detailed description of the preferred embodiment that is illustrated in the various figures and drawings.

DETAILED DESCRIPTION

The detailed description of the technical content, structural features, and the objects and effects of the technical solutions will be described in detail below with reference to the specific embodiments and the accompanying drawings.

Figure 1:
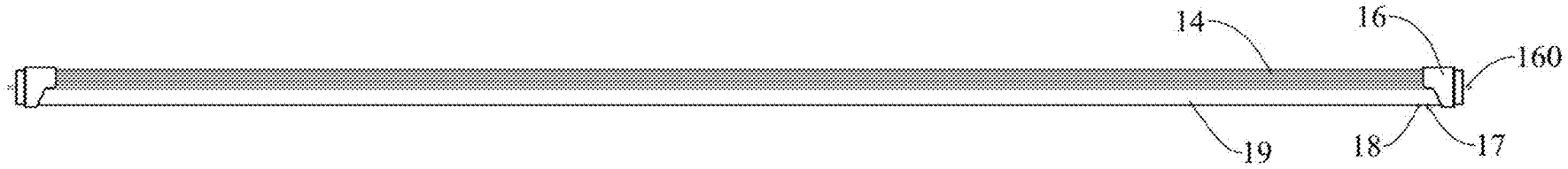
FIG. 1 illustrates a perspective view of an optical communication lamp device of an exemplary embodiment of the present invention.
Figure 2:
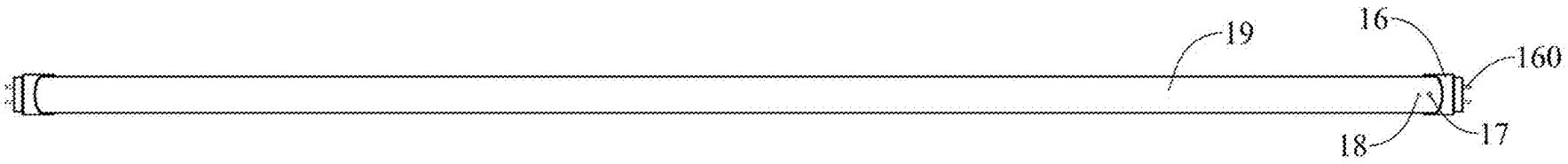
FIG. 2 illustrates a perspective view of an optical communication lamp device of an exemplary embodiment of the present invention.
Figure 3:
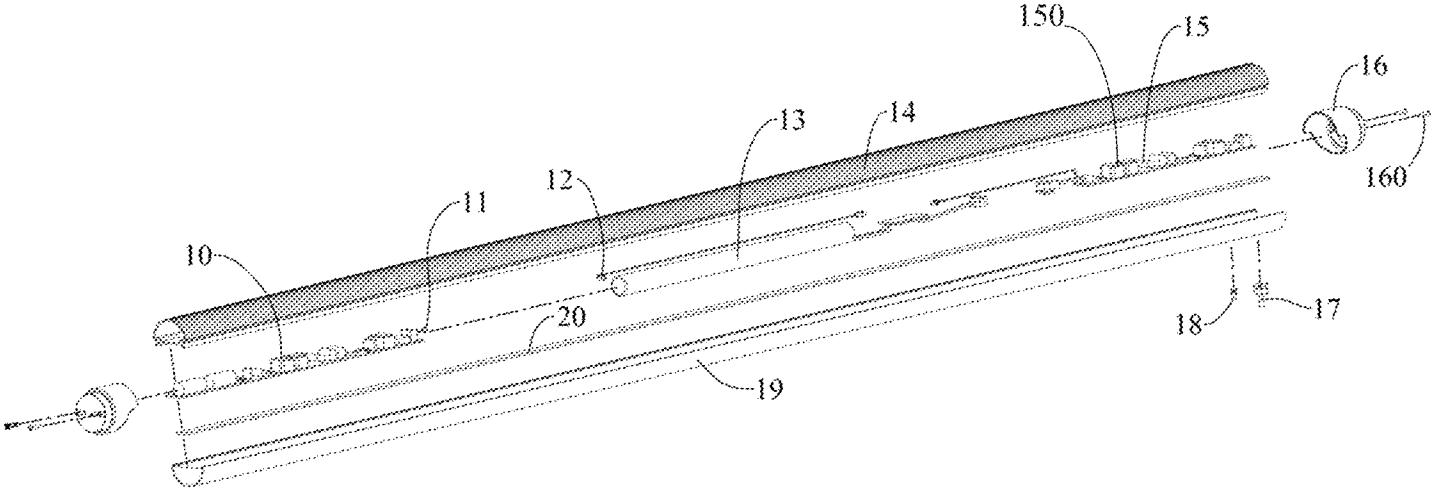
FIG. 3 illustrates an exploded view of an optical communication lamp device of an exemplary embodiment of the present invention.

Please refer to FIGS. 1 to 3. FIG. 1 illustrates a perspective view of an optical communication lamp device of an exemplary embodiment of the present invention. FIG. 2 illustrates a perspective view of an optical communication lamp device of an exemplary embodiment of the present invention. FIG. 3 illustrates an exploded view of an optical communication lamp device of an exemplary embodiment of the present invention.

In the first embodiment of the present invention, an optical communication lamp device comprises a receiving-end driving power circuit 10, a receiving-end power circuit receiver 11, an emitting-end emitter 12, a power unit 13, a lamp tube heat-dissipation member 14, an emitting-end driving controller 15, at least one lamp socket 16, a test switch 17, a test indicating light 18, a lightshade 19, and a light emitting element 20.

The lamp tube heat-dissipation member 14 is an aluminum manufacture. The lamp tube heat-dissipation member 14 has an assembly surface. The receiving-end driving power circuit 10, the receiving-end power circuit receiver 11, the emitting-end emitter 12, the power unit 13 and the emitting-end driving controller 15 are disposed on the assembly surface of the lamp tube heat-dissipation member 14. The power unit 13 may be a battery or a chargeable battery. The emitting-end emitter 12 may be an optical emitting member. The receiving-end power circuit receiver 11 may be an optical receiving member.

The receiving-end driving power circuit 10 is electrically connected to the receiving-end power circuit receiver 11. The emitting-end emitter 12 is electrically connected to the emitting-end driving controller 15.

The lampshade 19 covers the assembly surface of the lamp tube heat-dissipation member 14, so that the receiving-end driving power circuit 10, the receiving-end power circuit receiver 11, the emitting-end emitter 12, the power unit 13 and the emitting-end driving controller 15 are between the lampshade 19 and the lamp tube heat-dissipation member 14.

The light emitting member 20 may be a plate member having a plurality of light emitting diodes. The light emitting member 20 is disposed between the lampshade 19 and the lamp tube heat-dissipation member 14. The light emitting element 20 is electrically connected to the receiving-end driving power circuit 10, the power unit 13, and the emitting-end driving controller 15.

In this embodiment, the number of the lamp sockets 16 is two. The two lamp sockets 16 are respectively disposed on two ends of an assembly of the lampshade 19 and the lamp tube heat-dissipation member 14. Each of the lamp sockets 16 has a copper pin 160, and the copper pin 160 is electrically connected to the light emitting element 20.

The test switch 17 and the test indicating light 18 are disposed on one end of the lampshade 19 and electrically connected to the light emitting element 20.

Please refer to FIGS. 2 and 3. When the copper pin 160 of the lamp socket 16 is connected to a power supply source, for example, a mains supply or a test power supply, the power supply provides electricity to the light emitting element 20 through the copper pin 160, so that the light emitting diodes of the light emitting element 20 illuminate lights. The lights are then emitted outwardly through the lampshade 19 for illuminating the space outward the lamp device. Moreover, the electricity can charge the power unit 13 at the same time.

When the test switch 17 is turned on, the power supply does not provide electricity to the light emitting element 20; instead, the power unit 13 provides electricity to the light emitting element 20, so that the light emitting diodes of the light emitting element 20 illuminate lights. Moreover, the test indicating light 18 is turned on so as to indicate that the power unit 13 of the lamp device is in use or the lamp device is in a test state.

When the test switch 17 is turned off, the power unit 13 does not provide electricity to the light emitting element 20, and again the power supply provides electricity to the light emitting element 20. Moreover, the test indicating light 18 is turned off so as to indicate that the lamp device is in a charging state or the lamp device is powered by the power supply.

A controller 150 (for example, may be or may have an encoder) emits an electrical signal (which is a duty ratio signal with a specific frequency), e.g., an electrical signal with a frequency from 1 Hz to 100 KHz. The emitting-end driving controller 15 receives the electrical signal emitted from the controller 150. The electrical signal is converted by the emitting-end emitter 12 to be an optical signal with a certain wavelength. The optical signal is radiated to the space having the lamp device through the emitting-end emitter 12.

The receiving-end power circuit receiver 11 receives the optical signal from the emitting-end emitter 12, and converts the optical signal into an electrical signal (which is a duty ratio signal with a specific frequency), and then the electrical signal is amplified and transmitted to a decoder of the receiving-end driving power circuit 10 for decoding. The decoded signal is then outputted by the decoder to execute a corresponding signal, for example, to allow the lamp device to be in a mode in which the electricity is powered by the power supply or in a mode in which the electricity is powered by the power unit 13.

According to one or some embodiments, the optical communication lamp device has following advantages.

First, the electrical signal (with high and low level) is transmitted to the emitting-end emitter 12, and then is converted by the emitting-end emitter 12 to be an optical signal with a specific wavelength, and the optical signal is radiated to the space where the lamp device is located. Next, the receiving-end power circuit receiver 11 receives the signal from the emitting-end emitter 12 and converts the optical signal into a second electrical signal (a duty ratio signal with a specific frequency). Then the second electrical signal is amplified to allow the receiving-end driving power circuit 10 to perform the high and low level signal control. Second, the two electrical-isolated systems within the lamp tube and the enclosed lamp device are capable of performing communication through the optical emitting and receiving components. Third, issues of the electromagnetic waves produced by the control of the wired-connected components can be reduced. Fourth, compared with radiofrequency communication, optical communication does not generate additional radio frequency electromagnetic wave problems. Fifth, the production efficiency can be improved and the cost problem caused by using the wire can be reduced.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An optical communication lamp device, comprising: an emitting-end driving controller, a power unit, an encoder, and a light emitting element, wherein the light emitting element is electrically connected to the emitting-end driving controller and the power unit; wherein the encoder emits an electrical signal; and the emitting-end driving controller receives the electrical signal emitted from the encoder to control the light emitting element; wherein the power unit is a battery or a chargeable battery; the emitting-end emitter is an optical emitting member; the receiving-end power circuit receiver is an optical receiving member.

2. The optical communication lamp device according to claim 1, further comprising an emitting-end emitter and a receiving-end power circuit receiver, wherein the emitting-end emitter is electrically connected to the emitting-end driving controller, the receiving-end power circuit receiver is electrically connected to the light emitting element, the emitting-end emitter converts the electrical signal into an optical signal and the optical signal is adapted being radiated outwardly to a space where the lamp device is located, and the receiving-end power circuit receiver receives the optical signal.

3. The optical communication lamp device according to claim 2, further comprising a receiving-end driving power circuit, wherein the receiving-end driving power circuit is electrically connected to the receiving-end power circuit receiver and the light emitting element, the receiving-end power circuit converts the optical signal into a second electrical signal, a decoder of the receiving-end driving power circuit decodes the second electrical signal being a decoded signal, and the decoder outputs the decoded signal to execute a corresponding function.

4. The optical communication lamp device according to claim 3, further comprising a lamp tube heat-dissipation member and a lampshade, wherein the lamp tube heat-dissipation member has an assembly surface, the receiving-end driving power circuit, the receiving-end power circuit receiver, the emitting-end emitter, the power unit, and the emitting-end driving controller are disposed on the assembly surface; the lampshade covers the assembly surface, so that the receiving-end driving power circuit, the receiving-end power circuit receiver, the emitting-end emitter, the power unit, and the emitting-end driving controller are between the lampshade and the lamp tube heat-dissipation member; the light emitting member is disposed between the lampshade and the lamp tube heat-dissipation member.

5. The optical communication lamp device according to claim 4, further comprising at least one lamp socket, the at least one lamp socket is disposed on one end of an assembly of the lampshade and the lamp tube heat-dissipation member; the at least one lamp socket has a copper pin electrically connected to the light emitting element.

6. The optical communication lamp device according to claim 5, wherein the optical communication lamp device comprises two lamp sockets, and the two lamp sockets are respectively disposed on two ends of the assembly of the lampshade and the lamp tube heat-dissipation member.

7. The optical communication lamp device according to claim 4, further comprising a test switch and a test indicating light, wherein the test switch and the test indicating light are disposed on one end of the lampshade and electrically connected to the light emitting element.

8. The optical communication lamp device according to claim 1, wherein the light emitting element is a plate member having a plurality of light emitting diodes.

* * * * *